United States Patent [19]

Rayboy

[11] 4,236,552

[45] Dec. 2, 1980

[54] GASOLINE PUMP CLIP CAP

[76] Inventor: Eric R. Rayboy, 1051-G NW. 80 Ter., Margate, Fla. 33063

[21] Appl. No.: 35,713

[22] Filed: May 3, 1979

[51] Int. Cl.[3] ..... B65B 3/04; G05G 5/06

[52] U.S. Cl. ..... 141/98; 7/100; 141/392; 220/DIG. 33

[58] Field of Search ..... 7/100; 74/526; 141/1, 141/98, 392; 220/DIG. 33; 251/90, 111

[56] References Cited

U.S. PATENT DOCUMENTS 4,095,629 6/1978 Jordan ..... 141/392

4,175,595 11/1979 Noe ..... 141/1

4,176,695 12/1979 Raske ..... 141/392 X

*Primary Examiner*—Frederick R. Schmidt

[57] ABSTRACT

The gasoline pump clip cap is a novel gas cap which has a "C"-shaped clip incorporated into its design. It serves two purposes: it seals the opening of an automobile gas tank filler pipe like a standard gas cap, and the integral clip can be temporarily installed onto the handle of a gas pump to hold the gas pump handle trigger in the on position. The gasoline customer can release the manual pressure on the trigger while using the clip to maintain the gas flow, thus allowing him to attend to other automobile maintenance chores in the time saved.

5 Claims, 3 Drawing Figures

GASOLINE PUMP CLIP CAP

The present invention relates to an improvement in the standard gas cap commonly used for sealing automobile gasoline tank filler pipes.

Heretofore, there have been a number of gas caps designed and manufactured in various shapes and sizes. These devices usually performed a single function, that of preventing loss or contamination of the contents of an automobile gas tank by sealing the filler pipe. The present invention differs from those heretofore known in that it contains a "C"-shaped clip incorporated into the rear or handle portion of the gas cap; this clip can be used to perform a second function. It can be temporarily installed onto the handle of a gasoline pump to maintain the flow of gas after manual pressure has been removed. Accordingly, the use of a self-service gasoline pump will be facilitated.

IN THE DRAWINGS

Figure 1:
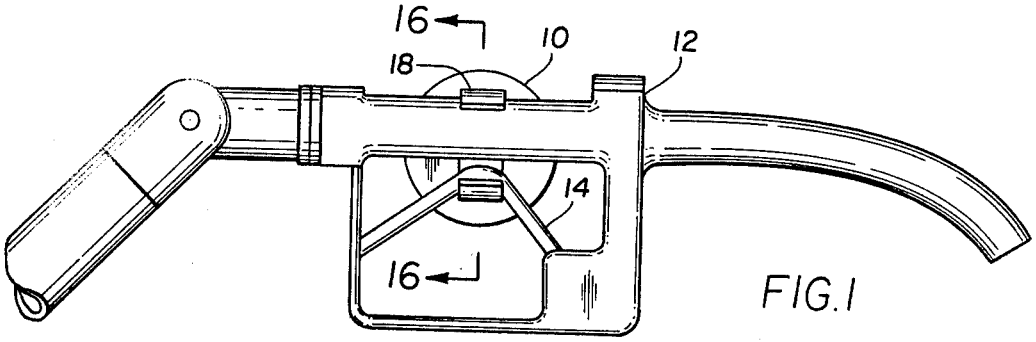
FIG. 1 is a side view of the Gas Pump Clip Cap installed in position for functioning on a gasoline pump handle.

Referring now to FIG. 1, the Gas Pump Clip Cap 10 is installed on a gas pump handle 12 to maintain the gas pump handle trigger 14 in the on position.

When a gasoline customer pulls into a self-service gas station, he parks the car next to the pump, turns off the ignition, resets the pump reading to zero, removes the gas cap, and inserts the gas pump nozzle into the car's gas tank filler pipe. Once these preparations are complete, the customer must pull the gas pump handle trigger 14 into the on position to begin pumping gasoline onto the car's tank. He continues to apply pressure to the gas pump handle trigger 14 to maintain the flow of gasoline, and if the gas pump handle trigger 14 is released, the gasoline stops flowing. The manual pressure serves to keep the gas pump handle trigger 14 in the on position; the Gas Pump Clip Cap 10 can be substituted for the continued manual pressure since it will hold the gas pump handle trigger 14 in the on position, as shown in FIG. 1. Once the customer pulls the gas pump handle trigger 14 into the on position, he can temporarily install the Gas Pump Clip Cap 10 onto the gas pump handle 12 by slipping the Gas Pump Clip Cap 10 around both the gas pump handle 12 and the gas pump handle trigger 14; when he releases his grip on the gas pump handle trigger 14, the gas pump handle trigger 14 is held in the on position by the functioning Gas Pump Clip Cap 10. The gasoline will continue to flow into the car's tank until the tank is filled and the gas pump shuts off automatically. The customer then removes the Gas Pump Clip Cap 10 from the gas pump handle 12 and replaces it into the gas tank filler pipe. The customer is freed from the need to maintain manual pressure on the gas pump handle trigger 14, and during the time saved while the tank is filling, he can now attend to other maintenance chores such as checking the tire pressure or checking the oil level, etc.

Figure 2:
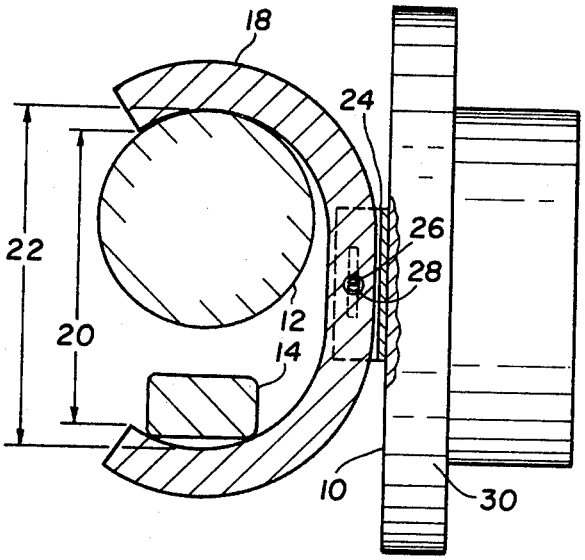
FIG. 2 is a cross-sectional view of the Gas Pump Clip Cap.

Referring now to FIG. 2, the cross-sectional view of the Gas Pump Clip Cap 10, taken along lines 16—16 of FIG. 1, shows the details of the invention. The clip portion 18 of the device is "C"-shaped with an opening 20 large enough to accommodate the easy entry of the gas pump handle 12 and the gas pump handle trigger 14. The maximum internal accommodation length 22 of the clip portion 18 is only slightly larger than the opening 20 in order to hold the gas pump handle trigger 14 in close proximity to the gas pump handle 12, thus maintaining the continuity of gasoline flow.

Figure 3:
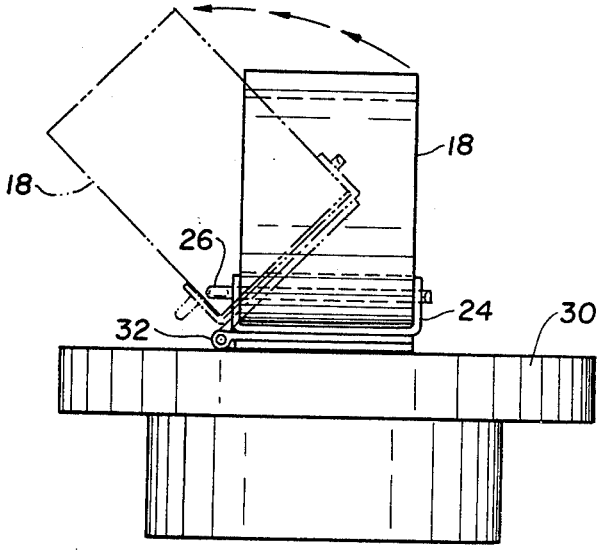
FIG. 3 shows a different mounting for the clip.

The clip portion 18 is held onto the clip mounting flange 24 by a cotter pin 26 passed through co-linear holes 28; the clip mounting flange 24 is a "U"-shaped channel. If the clip portion 18 is damaged, it can be removed and replaced by taking the cotter pin 26 from the co-linear holes 28. The clip mounting flange 24 can be permanently fixed in position and firmly mounted onto the gas cap portion 30 of the device as shown in FIG. 2, or it may be mounted with a hinge so that the clip portion 18 can be folded over; this feature may be desirable or necessary due to space considerations. As shown in FIG. 3 the clip mounting flange 24 is attached to the cap by means of a hinge 32. The gas cap portion 30 of the Gas Pump Clip Cap 10 is of the standard configuration and can be of any size or shape required. The various components of the Gas Pump Clip Cap 10 can be manufactured from metal, plastic, or other suitable material using standard manufacturing techniques for material forming or casting.

The invention provides a simple method of maintaining gasoline flow into a customer's car without manual pressure being constantly applied to the gas pump handle trigger 14. The customer can use the free time to attend to other maintenance duties.

What is claimed is:

1. A gas pump clip cap comprising:

(a) A gas cap of standard configuration, said gas cap having a U-shaped channel or flange mounted on its rear or handle portion; and (b) a C-shaped clip mounted onto said flange; whereby said gas pump clip cap can function to both seal the filler pipe of an automobile gas tank and, when removed from said filler pipe, said clip of said gas pump clip cap can function to maintain the handle of a gasoline pump in an operable position.

2. The gas pump clip cap of claim 1 wherein said mounting is secured by a cotter pin passed through colinear holes through said clip and said flange.

3. The gas pump clip cap of claim 1 wherein said flange is mounted onto said gas cap with a hinge.

4. The gas pump clip cap of claim 1 wherein said clip has an opening of sufficient size to accommodate both a gas pump handle and a gas pump handle trigger.

5. The gas pump clip cap of claim 1 wherein said clip has a maximum internal dimension of sufficient size to hold a gas pump handle and a gas pump handle trigger in close proximity.

* * * * *